US009584893B2

(12) United States Patent
Turner

(10) Patent No.: US 9,584,893 B2
(45) Date of Patent: Feb. 28, 2017

(54) APPARATUS AND METHOD FOR RECOVERING FROM PARTIAL INSERTION OF AN AUDIO JACK

(71) Applicant: Fairchild Semiconductor Corporation, San Jose, CA (US)

(72) Inventor: John R. Turner, Portland, ME (US)

(73) Assignee: FAIRCHILD SEMICONDUCTOR CORPORATION, San Jose, CA (US)

( * ) Notice: Subject to any disclaimer, the term of this patent is extended or adjusted under 35 U.S.C. 154(b) by 121 days.

(21) Appl. No.: 14/597,953

(22) Filed: Jan. 15, 2015

(65) Prior Publication Data

US 2015/0208155 A1 Jul. 23, 2015

Related U.S. Application Data

(60) Provisional application No. 61/929,372, filed on Jan. 20, 2014.

(51) Int. Cl.
*H04R 1/06* (2006.01)
*H04R 29/00* (2006.01)
*H04R 1/10* (2006.01)

(52) U.S. Cl.
CPC ..... *H04R 1/06* (2013.01); *H04R 1/1033* (2013.01); *H04R 29/00* (2013.01)

(58) Field of Classification Search
CPC ..... H04R 1/06; H04R 29/00
USPC ..... 307/116; 324/705, 750.3; 340/13.27; 381/58, 74, 94.1, 122, 151, 385, 394; 455/23, 95, 115.1, 567, 575.2; 718/102; 439/620.21, 628; 710/300
See application file for complete search history.

(56) References Cited

U.S. PATENT DOCUMENTS 5,960,367 A * 9/1999 Kita ..... H04B 1/38 455/11.1
7,142,123 B1 11/2006 Kates
8,492,661 B2 7/2013 Jol
9,031,253 B2 5/2015 Shah et al.
9,294,857 B2 * 3/2016 Prentice ..... H04R 29/004
(Continued)

FOREIGN PATENT DOCUMENTS

CN 104796820 A 7/2015
CN 104796839 A 7/2015
(Continued)

OTHER PUBLICATIONS

"U.S. Appl. No. 14/597,910, Non Final Office Action mailed Jul. 8, 2016", 15 pgs.

*Primary Examiner* — Gerald Gauthier
(74) *Attorney, Agent, or Firm* — Schwegman Lundberg & Woessner, P.A.

(57) ABSTRACT

Apparatus and methods for recovering from an audio jack connection anomaly such as a partial insertion of an audio jack plug with an audio jack receptacle are provided. In an example, a method can include detecting a valid audio jack connection of an audio jack receptacle and an audio jack plug, detecting a change in a state of a detect switch associated with the audio jack connection, applying an oscillating signal to a microphone terminal associated with the audio jack connection, determining the state of the detect switch stays constant for a predetermined time, and isolating the oscillating signal from the microphone terminal.

19 Claims, 4 Drawing Sheets

(56) References Cited

U.S. PATENT DOCUMENTS

2001/0034214 A1* 10/2001 Koike ..... H04B 1/04 455/95
2003/0013499 A1* 1/2003 Aotake ..... H04M 1/6058 455/575.2
2003/0115240 A1* 6/2003 Cho ..... G06Q 10/109 718/102
2005/0020205 A1* 1/2005 Khoini-Poorfard ..... H04B 1/30 455/23
2005/0020217 A1* 1/2005 Khoini-Poorfard .. H04B 1/0475 455/115.1
2006/0058069 A1* 3/2006 Garcia ..... H04B 1/3833 455/567
2007/0133828 A1 6/2007 Kanji
2007/0223718 A1* 9/2007 Felder ..... H04R 3/04 381/74
2008/0107288 A1* 5/2008 Chen ..... H04R 19/016 381/122
2009/0179768 A1* 7/2009 Sander ..... H04M 1/05 340/13.27
2010/0127848 A1 5/2010 Mustapha et al.
2010/0151740 A1* 6/2010 Hogue ..... H01R 9/031 439/638
2010/0260371 A1* 10/2010 Afshar ..... H04R 7/24 381/394
2011/0237131 A1* 9/2011 Fields ..... H01R 13/7039 439/620.21
2011/0300751 A1 12/2011 Wittenberg et al.
2012/0019306 A1 1/2012 Turner et al.
2012/0050151 A1 3/2012 Dabov et al.
2012/0051007 A1 3/2012 Alvarez et al.
2012/0051015 A1 3/2012 Dabov et al.
2013/0020882 A1* 1/2013 Prentice ..... H04R 29/004 307/116
2013/0021046 A1* 1/2013 Prentice ..... H04R 29/004 324/705
2013/0034242 A1* 2/2013 Prentice ..... H04R 29/004 381/94.1
2013/0156216 A1* 6/2013 Shah ..... H04R 5/04 381/74
2013/0202134 A1* 8/2013 Afshar ..... H04R 1/22 381/151
2014/0038460 A1 2/2014 Lee
2014/0056461 A1* 2/2014 Afshar ..... H04R 1/00 381/385
2014/0281093 A1* 9/2014 Beckman ..... G06F 13/409 710/300
2015/0043757 A1 2/2015 Prentice
2015/0208154 A1* 7/2015 Turner ..... H04R 29/00 381/58
2015/0208155 A1* 7/2015 Turner ..... H04R 1/06 381/58

FOREIGN PATENT DOCUMENTS

KR 1020150008688 A 7/2015
KR 1020150087123 A 7/2015

* cited by examiner

APPARATUS AND METHOD FOR RECOVERING FROM PARTIAL INSERTION OF AN AUDIO JACK

CLAIM OF PRIORITY AND RELATED APPLICATIONS

This application claims the benefit of priority under 35 U.S.C. 119(e) to Turner, U.S. Provisional Patent Application No. 61/929,372, filed on Jan. 20, 2014, and titled, "APPARATUS AND METHOD FOR RECOVERING FROM PARTIAL INSERTION OF AN AUDIO JACK," which is hereby incorporated by reference herein in its entirety.

BACKGROUND

Many mobile devices, such as mobile phones or other portable electronics, include audio jacks and are configured to distinguish between a variety of external audio jack accessories using either the baseband processor of the mobile device or a detection circuit. Automatic detection of the connection or the disconnection of an accessory device can improve a user's experience as the detection process can reduce the effort required by a user to enjoy the benefits of a connected accessory. However, since the mobile device and the accessory are exposed, and rely on certain user actions to connect or disconnect each to each other, failure to establish a proper connection such as by a partial insertion of the audio jack plug or moisture on the audio jack connectors can cause detection failures and can result in a degraded user experience.

OVERVIEW

Apparatus and methods for recovering from an audio jack connection anomaly such as a partial insertion of an audio jack plug with an audio jack receptacle are provided. In an example, a method can include detecting a valid audio jack mating or connection of an audio jack receptacle and an audio jack plug, detecting a change in a state of a detect switch associated with the audio jack connection, applying an oscillating signal to a microphone terminal associated with the audio jack connection, determining the state of the detect switch stays constant for a predetermined time, and isolating the oscillating signal from the microphone terminal.

This overview is intended to provide a partial summary of the subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

In an example, a system can include a device, such as a cellular phone, a portable music player, or one or more other portable or other devices configured to receive an audio jack. The device can include a processor (e.g., a baseband processor, etc.) and an audio jack receptacle (e.g., a three-pole audio jack receptacle, a four-pole audio jack receptacle, or one or more other audio jack receptacles) configured to receive an audio jack (e.g., a three-pole audio jack, a four-pole audio jack, or one or more other audio jacks corresponding to the audio jack receptacle) coupled to an external device, such as a microphone, a speaker, a headset, or one or more other external devices. The audio jack receptacle can be configured to receive an input (e.g., a microphone input, send/end key detection, one or more other external input, etc.) from the external device, or to provide an output (e.g., a speaker output, an external device control, etc.) to the external device.

In certain examples, the mobile device can be programmed or can include a circuit to detect connection of an accessory device using the audio jack and can detect disconnection of the accessory. Such detection functions can automatically configure the processor for use with the accessory device when connected and for use when the accessory device is removed. However, when the accessory device is partially connected, for example, when the audio jack plug is partially inserted into the audio jack receptacle, or when the connection of the accessory is contaminated such as by moisture, the detection functions as well as functional components of the mobile device can crash or become unreliable. In some detection methods, moisture present at the audio jack connector or partial insertion or retraction of the audio jack plug can result in audible tone being broadcast on a pin that is often associated with a speaker, such as an earbud speaker.

The present inventor has recognized apparatus and methods for complimenting the detection functions that can allow for graceful detection and recovery from less than optimum connection of an accessory device without generating unanticipated sounds on an accessory earbud speaker or other kind of speaker.

Figure 1:
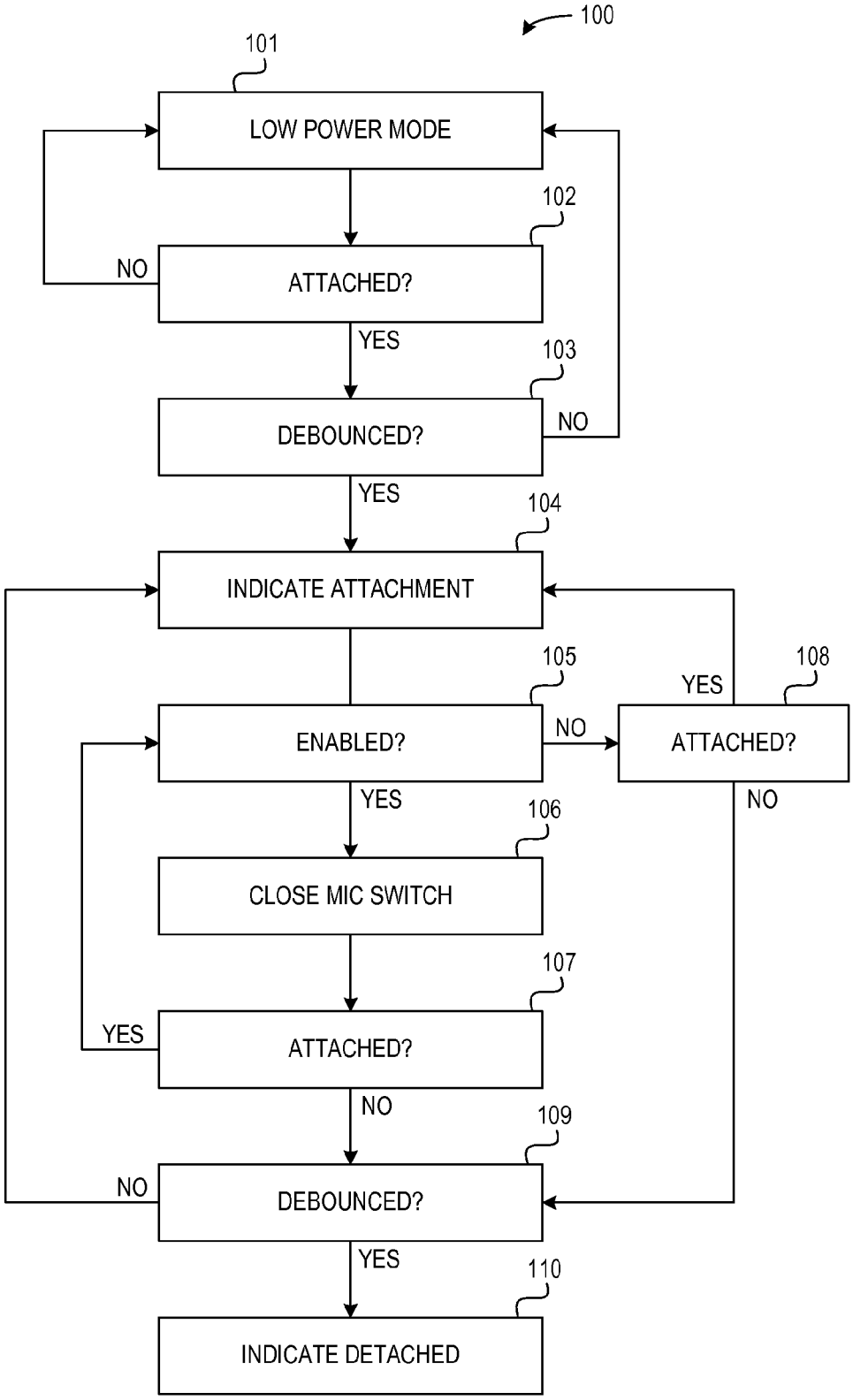
FIG. 1 illustrates an example method 100 for monitoring connection of an audio jack to or from a mobile device.

FIG. 1 illustrates an example method 100 for monitoring connection of an audio jack to or from a mobile device. At 101, the method 100 can start with the audio jack not connected to the mobile device and the mobile device in a low-power operating mode that includes disabling circuits that can be used to operate an accessory device. At 102, one or more of the contacts associated with the audio jack can be monitored to detect whether an audio jack plug has been or is being inserted into an audio jack receptacle. In certain examples, the audio jack receptacle is associated with the mobile device and the audio jack plug is associated with the accessory device. In certain examples, the audio jack receptacle is associated with the accessory device and the audio jack plug is associated with the mobile device. At 103, if insertion is detected, the connection of the audio jack plug and the audio jack receptacle can be debounced. If the connection is not maintained over the debounce interval, the method 100 can maintain the low-power operating mode and can continue to monitor for an addition indication of an insertion of an audio jack plug. At 104, if an audio jack connection is maintained over the debounce interval, an attachment indication can be enabled to indicate to the processor of the mobile device that an accessory is attached. At 105, the method 100 can monitor an enable input, such as an enable input from the mobile device processor and if the input is in the proper enable command state, at 106, certain actions can be executed to take advantage of the functionality of the accessory including, for example, enabling a microphone switch. In certain examples, the mobile device processor can exit the low-power mode when the accessory device is enabled. After enabling the accessory device, the method 100 can monitor for disconnection of the audio jack at 107. Referring to the method flow at 108, if the enable input remains in a disable command state, the method 100 can continue to monitor that the accessory is attached to the mobile device by, for example, opening and closing a microphone switch and monitoring one or more of the other audio jack inputs for a similar pattern that indicates the audio jack is not completely inserted or is in the process of being retracted from the receptacle. At 109, the connection is again debounced by monitoring the state of one of the audio jack contacts. At 110, if the state of the contact remains stable and indicates the audio jack is not connected, the method 100 can return to the low-power mode of operation. At 109, if the state of the contact indicates that the audio jack is connected, the method 100 can return to 104 and 105 to provide a connection indication and to monitor the enable input. The present inventor has recognized that in certain situations, an improper insertion or the present of moisture can result in the audio detection method getting caught in a loop that can place an audible tone on a speaker of an accessory device.

Figure 2A:
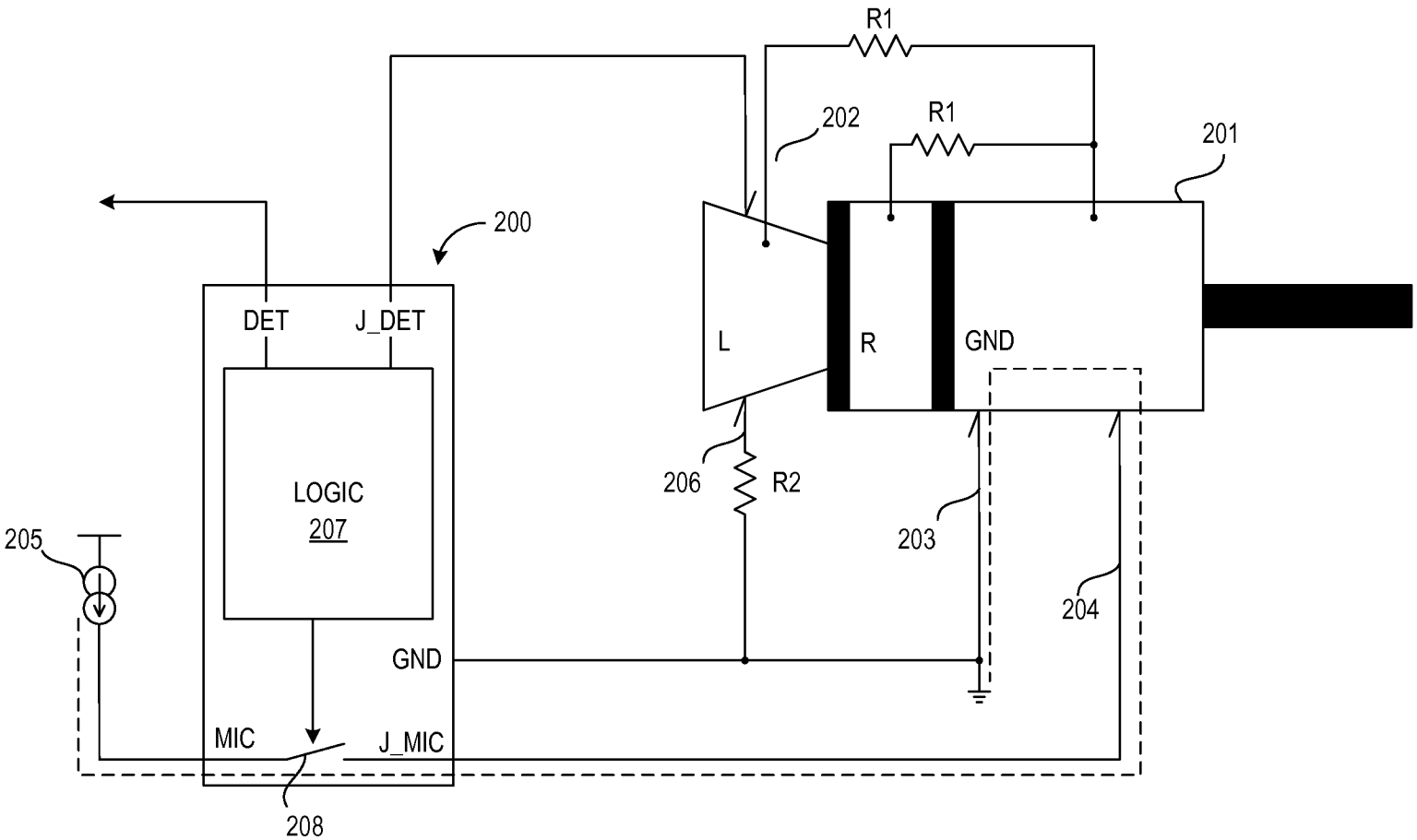
FIG. 2A illustrates generally a example detection circuit 200 coupled to a fully inserted audio jack plug 201.

FIG. 2A illustrates generally an example detection circuit 200 coupled to an audio jack receptacle and a fully inserted audio jack plug 201. The audio jack plug 201 can include a first contact 202 sometimes associated with a left speaker contact (L) of an accessory, a second contact 203 and a third contact 204 associated with a ground or common contact of an accessory. In certain examples, the detection circuit 200 can include a detection input (J_DET) a ground terminal (GND) and a microphone terminal (J_MIC). In some examples, the detection circuit 200 can include an output (DET) for providing indication that an accessory device is coupled to the mobile device. In some examples, the detection circuit 200 can include an enable input (not shown) for receiving enable and disable commands. In some examples, the detection circuit 200 can include detection logic 207 for receiving commands from the mobile device processor, for detecting certain events associated with an audio jack connector, for providing indication when an audio jack plug and an audio jack receptacle are properly connected, and for controlling one or more switches 208 to provide these functions. In some examples, such as when the mobile device can be connected to a microphone through an audio jack, the detection circuit 200 can receive a microphone bias (MIC). In certain examples, the mobile device can include a bias source 205, such as a current source, for biasing certain circuits of an accessory device such as a microphone. In some examples, the bias source 205 can be used to determine if an audio jack remains connected such as when a connection has been detected and debounced but the mobile device processor has not enabled the accessory. In such examples, the bias source 205 can be connected to the microphone terminal at a certain frequency and a different terminal such as detection input (J_DET) can be monitored. When the audio jack is correctly and fully inserted, the periodic connection of the bias source can be grounded using a path (dotted line) including the second contact 203 and the third contact 204 such that no disturbance is observed on the detection input (J_DET).

Figure 2B:
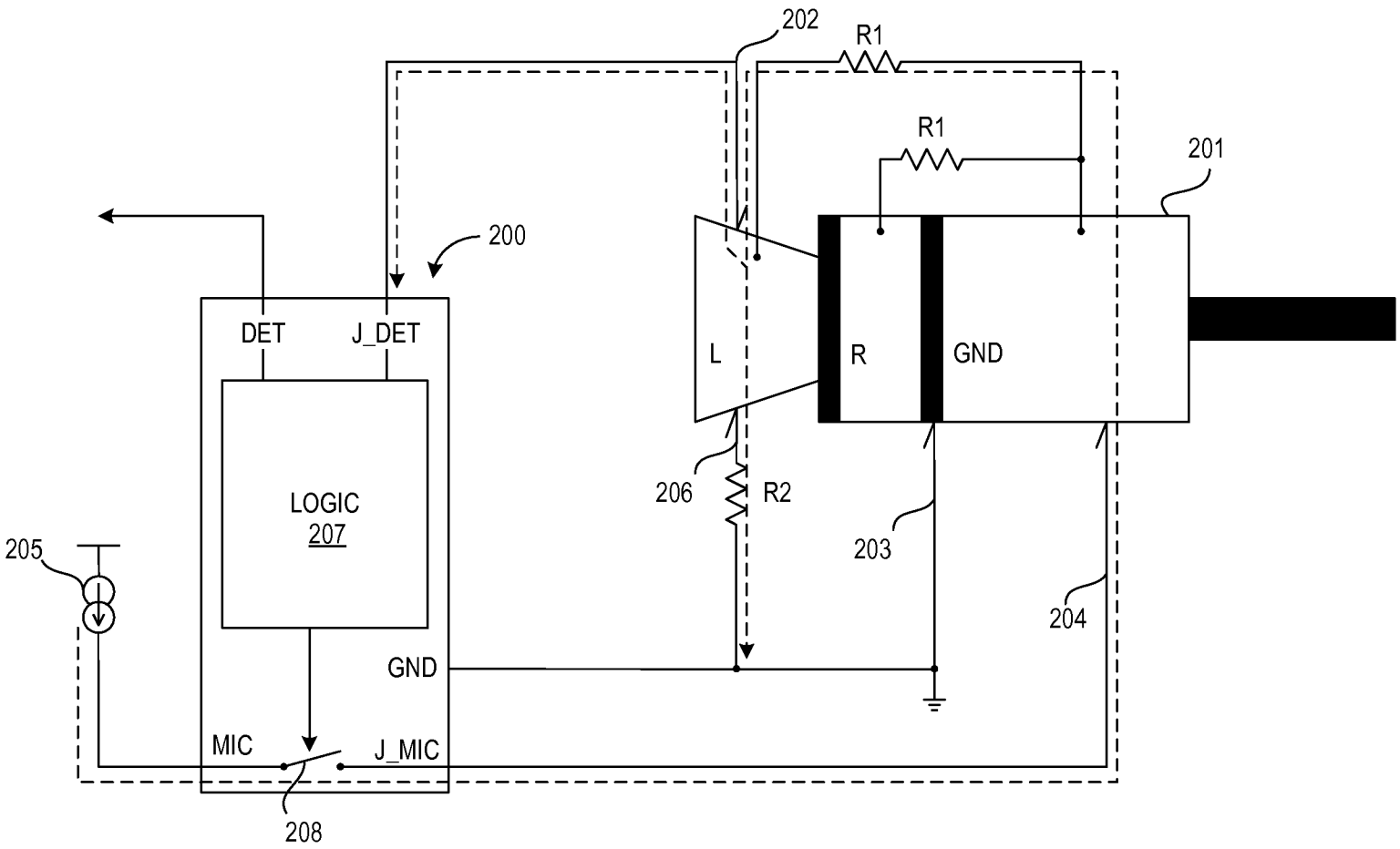
FIG. 2B illustrates generally an example detection circuit 200 coupled to a partially inserted or partially disconnected audio jack plug 201.

FIG. 2B illustrates generally an example detection circuit 200 coupled to a partially inserted or partially disconnected audio jack plug 201. In such a situation, periodic connection of the bias source 205 can result in disturbance being detected on the detection input (J_DET) through a path (dotted line) including the first contact 202, the third contact 204, and a resistive contact 206 coupled to ground. In certain situations, similar disturbances can be detected on fully and properly inserted audio jack connectors when moisture is present. In certain methods of detecting connection or disconnection of an audio jack connector, periodic connection of the bias source 205 to the microphone input (J_MIC) can result in annoying tones being broadcast on a speaker of an accessory device.

Figure 3:
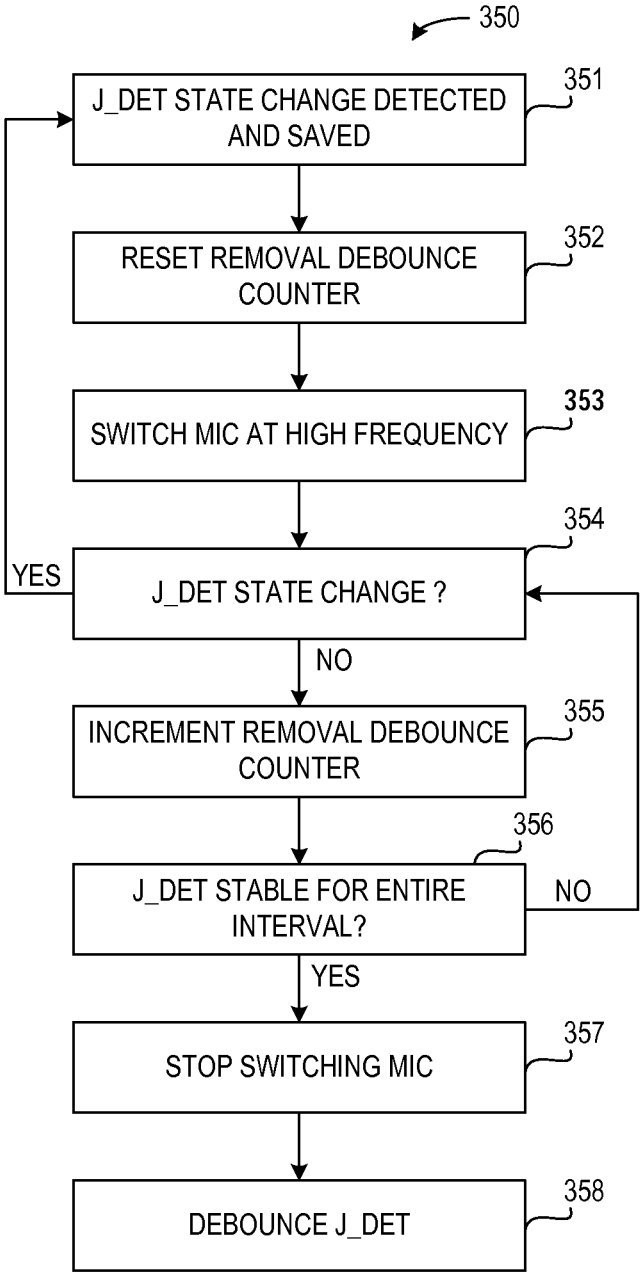
FIG. 3 illustrates generally a flowchart for an example method 350 of recovering from a connection anomaly.

FIG. 3 illustrates generally a flowchart for an example method 350 of recovering from a connection anomaly. Such an anomaly can include, but is not limited to, a partially inserted or removed audio jack plug, moisture present in the audio jack connection and electrical interference. The method 300 begins after an audio jack connection has been detected, debounced and an indication of a properly inserted audio jack plug has been provided to the mobile device processor. At 351, the detection input changes state indicating the audio jack plug may be removed or in the process of being removed and the last state of the detection input is saved. At 352, a removal debounce counter is reset. At 353 the microphone switch can be toggled at a frequency above the audible range for human hearing such as above 20 kHz and the state of the detection input and the debounce interval can continued to be monitored. In certain examples, the microphone switch can couple an oscillating signal source to the microphone terminal to apply an oscillating signal to the microphone terminal. In certain examples, the oscillating signal can have a frequency at or above 20 kHz. In certain examples, the oscillating signal can have a frequency at or above 33 kHz. In certain examples, the oscillating signal source can include a bias source for an accessory microphone. At 354, the detect input can be compared to the saved state, the comparison can be evaluated for a change of the state of the detect input (J_DET), and the new state saved if a change is detected. If the state of the detect input (J_DET) has changed, the method loops and the removal debounce counter is reset at 352. In certain examples, the state of the detect input has changed if the current state equals the saved state. In some examples, the state of the detect input has changed if the current state does not equal the saved state. If the detect input state has not changed, the removal debounce counter is incremented at 355. At 356, the removal debounce counter is compared to a threshold or predetermined value to indicate that the detect input (J_DEC) has stabilized for a certain predetermined recovery check interval. If the second debounce timer has not reached the predetermined value, the method loops and the state of the detection input and the debounce interval can continue to be monitored. It is understood that is possible to implement the removal debounce counter as a countdown counter to indicate the conclusion of a time interval without departing from the scope of the present subject matter. In certain examples, the removal counter can be reset to a predetermined value or count and can be decremented to a second predetermined value, such as zero, to provide an adequate stabilization period for evaluating the state of the detect input (J_DET).

Referring to FIG. 2B, if the audio jack plug 201 is partially inserted, the detection input (J_DET) can receive a periodic signal indicative of the switching of the microphone switch. However, since the signal is at a frequency that is inaudible, the signal will not cause an audible tone, for example, if the audio jack plug 201 is being removed or detached from the mating receptacle and the third contact 204 is sliding over connection points for earbud speakers or other accessory speaker connection points. In certain examples, the switching frequency of the microphone switch (MIC) can be greater than 20 kilohertz. In some examples, the switching frequency of the microphone switch (MIC) can be about 33 kilohertz and the predetermined value can result in a debounce time of about 80 μsec.

Referring again to FIG. 3, at 356, if the removal debounce counter reaches the predetermined value, the audio jack plug may have been removed or fully inserted, the method 300, at 357, can then stop the switching of the microphone switch (MIC) and, at 358, can debounce the detect input (J_DET) to determine whether the audio jack has been fully inserted or fully removed. In certain examples, the non-switching debounce time can be less than 10 milliseconds. In some examples, the non-switching debounce time can be less than 5 milliseconds. In some examples, the non-switching debounce time can be about 1 millisecond.

EXAMPLES AND NOTES

In Example 1, a method can include detecting a valid audio jack connection of an audio jack receptacle and an audio jack plug, detecting a change in a state of a detect switch associated with the audio jack connection, applying an oscillating signal to a microphone terminal associated with the audio jack connection, determining the state of the detect switch stays constant for a predetermined time, and isolating the oscillating signal from the microphone terminal.

In Example 2, the detecting the valid audio jack connection of Example 1 optionally includes saving the state of one or more detect terminals associated with the valid audio jack connection to provide a saved state.

In Example 3, the detecting the valid audio jack connection of any one or more of Examples 1-2 optionally includes resetting a removal debounce counter.

In Example 4, the determining the state of the detect switch stays constant of any one or more of Examples 1-3 optionally includes comparing the state of the detect switch to the saved state to provide a comparison result.

In Example 5, the method of any one or more of Examples 1-4 optionally includes incrementing the removal debounce counter if the comparison state indicates that the state of the detect switch equals the saved state.

In Example 6, the method of any one or more of Examples 1-5 optionally includes resetting the removal debounce counter if the comparison state indicates that the state of the detect switch does not equal the saved state.

In Example 7, the determining the state of the detect switch stays constant for a predetermined time of any one or more of Examples 1-6 optionally includes evaluating of the removal debounce counter is equal to or greater than an interval threshold count.

In Example 8, the applying an oscillating signal to a microphone terminal of any one or more of Examples 1-7 optionally includes applying an oscillating signal having a frequency equal to or greater than 20 kHz.

In Example 9, the applying an oscillating signal to a microphone terminal of any one or more of Examples 1-8 optionally includes applying an oscillating signal having a frequency equal to or greater than 33 kHz.

In Example 10, the detecting a valid audio jack connection of an audio jack receptacle and an audio jack plug of any one or more of Examples 1-9 optionally includes enabling an accessory device coupled to a mobile device via the valid audio jack connection.

In Example 11, the enabling the accessory device of any one or more of Examples 1-10 optionally includes exiting a low-power mode of the mobile device.

In Example 12, the method of any one or more of Examples 1-3 optionally includes detecting full detachment of the audio jack plug from the audio jack receptacle and entering a low-power mode of a mobile device coupled to the audio jack receptacle.

In Example 13, a detection circuit for a mobile device can include a detection input configured to couple to one or more terminals of an audio jack connector, a microphone output coupled to a first terminal of the one or more terminals of the audio jack connector, a switch coupled with the microphone output, and detection logic configured to detect a valid connection of the audio jack connector with a mating audio jack connector, detect a change in a state of the detection input, apply an oscillating signal to the microphone output using the switch, determine the state of the detect switch stays constant for a predetermined time; and isolate the oscillating signal from the microphone terminal at the conclusion of the predetermined time.

In Example 14, the detection circuit of any one or more of Examples 1-13 optionally includes memory to save a state of the detection input to provide a saved state.

In Example 15, the detection circuit of any one or more of Examples 1-14 optionally includes a removal detection counter and wherein the logic is configured to compare the saved state to a current state of the detect input and increment the removal detection counter each time the current state matches the saved state.

In Example 16, the predetermined time of any one or more of Examples 1-15 optionally is configured to conclude when the removal detection counter reaches a predetermined count.

In Example 17, the oscillating signal of any one or more of Examples 1-16 optionally is configured to have a frequency above the audible range of human hearing.

In Example 18, the oscillating signal of any one or more of Examples 1-17 optionally is configured to have a frequency at or above 20 kHz.

In Example 19, the oscillating signal of any one or more of Examples 1-18 optionally is configured to have a frequency at or above 33 kHz.

Example 20 can include, or can optionally be combined with any portion or combination of any portions of any one or more of Examples 1 through 19 to include, subject matter that can include means for performing any one or more of the functions of Examples 1 through 19, or a machine-readable medium including instructions that, when performed by a machine, cause the machine to perform any one or more of the functions of Examples 1 through 19.

The above detailed description includes references to the accompanying drawings, which form a part of the detailed description. The drawings show, by way of illustration, specific embodiments in which the invention can be practiced. These embodiments are also referred to herein as "examples." Such examples can include elements in addition to those shown or described. However, the present inventors also contemplate examples in which only those elements shown or described are provided. Moreover, the present inventors also contemplate examples using any combination or permutation of those elements shown or described (or one or more aspects thereof), either with respect to a particular example (or one or more aspects thereof), or with respect to other examples (or one or more aspects thereof) shown or described herein.

All publications, patents, and patent documents referred to in this document are incorporated by reference herein in their entirety, as though individually incorporated by reference. In the event of inconsistent usages between this document and those documents so incorporated by reference, the usage in the incorporated reference(s) should be considered supplementary to that of this document; for irreconcilable inconsistencies, the usage in this document controls.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

Method examples described herein can be machine or computer-implemented at least in part. Some examples can include a computer-readable medium or machine-readable medium encoded with instructions operable to configure an electronic device to perform methods as described in the above examples. An implementation of such methods can include code, such as microcode, assembly language code, a higher-level language code, or the like. Such code can include computer readable instructions for performing various methods. The code may form portions of computer program products. Further, in an example, the code can be tangibly stored on one or more volatile, non-transitory, or non-volatile tangible computer-readable media, such as during execution or at other times. Examples of these tangible computer-readable media can include, but are not limited to, hard disks, removable magnetic disks, removable optical disks (e.g., compact disks and digital video disks), magnetic cassettes, memory cards or sticks, random access memories (RAMs), read only memories (ROMs), and the like.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. A method comprising:

detecting a valid audio jack connection of an audio jack receptacle and an audio jack plug;

detecting a change in a state of a detect switch associated with the audio jack connection;

applying an oscillating signal to a microphone terminal associated with the audio jack connection;

determining the state of the detect switch stays constant for a predetermined time while the oscillating signal is applied;

isolating the oscillating signal from the microphone terminal; and providing an indication the audio jack receptacle and the audio jack plug are not connected.

2. The method of claim 1, wherein the detecting the valid audio jack connection includes saving the state of one or more detect terminals associated with the valid audio jack connection to provide a saved state.

3. The method of claim 2, wherein the detecting the valid audio jack connection includes resetting a removal debounce counter.

4. The method of claim 3, wherein the determining the state of the detect switch stays constant includes comparing the state of the detect switch to the saved state to provide a comparison result.

5. The method of claim 4, including incrementing the removal debounce counter if the comparison state indicates that the state of the detect switch equals the saved state.

6. The method of claim 4, including resetting the removal debounce counter if the comparison state indicates that the state of the detect switch does not equal the saved state.

7. The method of claim 4, wherein determining the state of the detect switch stays constant for a predetermined time includes evaluating of the removal debounce counter is equal to or greater than an interval threshold count.

8. The method of claim 1, wherein applying an oscillating signal to a microphone terminal includes applying an oscillating signal having a frequency equal to or greater than 20 kHz.

9. The method of claim 1, wherein applying an oscillating signal to a microphone terminal includes applying an oscillating signal having a frequency equal to or greater than 33 kHz.

10. The method of claim 1, wherein detecting a valid audio jack connection of an audio jack receptacle and an audio jack plug includes enabling an accessory device coupled to a mobile device via the valid audio jack connection.

11. The method of claim 10, wherein enabling the accessory device includes exiting a low-power mode of the mobile device.

12. The method of claim 1, including detecting full detachment of the audio jack plug from the audio jack receptacle, and entering a low-power mode of a mobile device coupled to the audio jack receptacle.

13. A detection circuit for a mobile device, the detection circuit comprising:

a detection input configured to couple to one or more terminals of an audio jack connector;

a microphone output coupled to a first terminal of the one or more terminals of the audio jack connector;

a switch coupled with the microphone output; and detection logic configured to detect a valid connection of the audio jack connector with a mating audio jack connector, detect a change in a state of the detection input, apply an oscillating signal to the microphone output using the switch, determine the state of the detect switch stays constant for a predetermined time while the oscillating signal is applied, isolate the oscillating signal from the microphone terminal at the conclusion of the predetermined time; and provide an indicate the audio jack connector and the mating audio jack connector are not connected.

14. The detection circuit of claim 13, including memory to save a state of the detection input to provide a saved state.

15. The detection circuit of claim 14, including a removal detection counter and wherein the logic is configured to compare the saved state to a current state of the detect input and increment the removal detection counter each time the current state matches the saved state.

16. The detection circuit of claim 15, wherein the predetermined time is configured to conclude when the removal detection counter reaches a predetermined count.

17. The detection circuit of claim 13, wherein the oscillating signal is configured to have a frequency above the audible range of human hearing.

18. The detection circuit of claim 13, wherein the oscillating signal is configured to have a frequency at or above 20 kHz.

19. The detection circuit of claim 13, wherein the oscillating signal is configured to have a frequency at or above 33 kHz.

* * * * *